US006443069B2

(12) United States Patent
Proffitt

(10) Patent No.: US 6,443,069 B2
(45) **Date of Patent: *Sep. 3, 2002**

(54) SIMULATED AMMUNITION

(75) Inventor: Jeffrey K. Proffitt, Greenback, TN (US)

(73) Assignee: Andrew R. Proffitt, Greenback, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/795,064

(22) Filed: Feb. 26, 2001

Related U.S. Application Data

(63) Continuation-in-part of application No. 09/239,126, filed on Jan. 28, 1999, now Pat. No. 6,223,657.

(51) Int. Cl.[7] ..... F42B 8/00

(52) U.S. Cl. ..... 102/444; 42/96; 42/106; 29/1.3

(58) Field of Search ..... 102/444; 42/96, 42/106; 29/1.3

(56) References Cited

U.S. PATENT DOCUMENTS

| | | | | |
|---|---|---|---|---|
| 2,405,308 A | 8/1946 | Jack | 35/25 |
| 2,882,821 A | 4/1959 | Benson | 102/444 |
| 3,027,840 A | 4/1962 | Hannas et al. | 102/444 |
| 3,785,293 A | 1/1974 | Barr et al. | 102/92.7 |
| 3,848,350 A | 11/1974 | Seminiano | 42/1 N |
| 4,100,693 A | 7/1978 | Cech | 42/1 N |
| 4,147,107 A | 4/1979 | Ringdal | 102/43 |
| 4,233,902 A | 11/1980 | Hartley et al. | 102/41 |
| 4,450,769 A | 5/1984 | Moser | 102/444 |
| 4,481,885 A | 11/1984 | Erickson et al. | 102/467 |
| 4,486,966 A | 12/1984 | Seehase | 42/1 N |
| 4,776,123 A | 10/1988 | Ascroft | 42/70.11 |
| 4,965,952 A | 10/1990 | Miller et al. | 42/70.01 |
| 5,021,206 A | 6/1991 | Stoops | 264/155 |
| 5,097,613 A | 3/1992 | Miller et al. | 42/70.01 |
| 5,291,832 A | 3/1994 | Plummer | 102/444 |
| 5,435,090 A | 7/1995 | Darrow | 42/95 |
| 5,859,090 A | 1/1999 | Shahid et al. | 523/124 |
| 6,223,657 B1 * | 5/2001 | Proffitt | 102/444 |

* cited by examiner

*Primary Examiner*—J. Woodrow Eldred
(74) *Attorney, Agent, or Firm*—Luedeka, Neely, & Graham, P.C.

(57) ABSTRACT

An ammunition simulant including a first portion having a stud portion and a head portion. The stud portion is in coaxial alignment with the head portion, wherein the stud portion includes at least one engagement member. The simulant also includes a second portion formed by an injection molding process including a mold, wherein injection material is injected into the mold and the material flows about the base portion and the engagement member of the stud portion forming a union. Whereupon the ammunition simulant is formed upon hardening of the molten material and removal of the mold.

8 Claims, 8 Drawing Sheets

SIMULATED AMMUNITION

RELATED APPLICATIONS

This application for letters patent is a continuation-in-part of application Ser. No. 09/239,126 filed on Jan. 28, 1999 (allowed) U.S. Pat. No. 6,223,657.

FIELD OF THE INVENTION

This invention relates generally to simulated ammunition devices. More particularly, this invention relates to simulated shotgun shells, simulated rimfire rounds and simulated centerfire rounds having a realistic appearance, feel and weight.

BACKGROUND AND SUMMARY OF THE INVENTION

Law enforcement agencies, hunter safety organizations and others often provide firearm safety training in an effort to reduce the incidence of firearm related accidents. Safe use of shotguns, rifles and pistols is often demonstrated in such training, with such training including instruction in loading ammunition into the firearm and unloading unfired ammunition from firearm. It is undesirable to use actual live shotgun shells and rifle and pistol rounds for training in view of the inherent safety risks. In an attempt to simulate a shotgun shell, it is common for instructors to use previously fired and now empty shotgun shells, the casings of which have been re-crimped. However, empty shells do not adequately simulate a live round. Likewise, the use of empty centerfire pistol and rifle rounds is not adequate.

With regard to the foregoing, the present invention is directed to a firearm ammunition simulant produced by an injection molding process.

In a preferred embodiment, the ammunition simulant includes a first portion having a stud portion and a head portion. In accordance with the invention, the stud portion includes at least one engagement member having a structure extending towards or away from the stud portion, wherein the stud portion is in coaxial alignment with the head portion. The simulant also includes a second portion, and according to the invention is formed by an injection molding process. The injection molding process includes a mold and wherein injection material is injected into the mold. The injection material flows about the first portion and the engagement member of the stud portion forming a union. The ammunition simulant is formed upon hardening of the molten material and removal of the mold. The hardened mold material in the engagement member substantially prevents accidental separation of the first and second portions of the simulant.

The first portion is preferably made of a metallic material, such as brass. The second portion is preferably molded from a polymeric material, such as plastic.

In accordance with the invention, a method is provided for manufacturing the ammunition simulant. A solid, one piece base portion is provided having a longitudinal axis, a head which is substantially cylindrical in shape and includes a circumferential rim, and a stud including at least one engagement member extends co-axial to the longitudinal axis of the base portion. An injection mold device is provided to perform the injection molding, the device including a mold and mold material. The mold is located proximate to the base portion of ammunition simulant and a predetermined amount of mold material is injected by the device into the mold to form a mold portion. The mold portion encompasses the stud and engagement member of the base portion. Upon hardening of the mold, a union is formed between the base portion and mold portion substantially preventing accidental separation thereof. The mold is removed, providing the ammunition simulant.

Simulated ammunition in accordance with the invention may be made to simulate shotgun shells, rimfire and centerfire rifle and pistol ammunition and other ammunition.

To simulate a shotgun shell, the first portion is configured to resemble the case or hull of a shotgun shell and the second portion is configured to resemble the brass or base portion of a shotgun shell.

To simulate rimfire ammunition, the first portion is configured to resemble the casing/bullet portion of rimfire ammunition and the second portion configured to resemble the base portion of rimfire ammunition where the primer is located.

To simulate centerfire ammunition, the first portion is configured to resemble the casing/bullet portion of centerfire ammunition and the second portion configured to resemble the base portion of centerfire ammunition where the primer is located.

The invention advantageously provides simulated ammunition which closely resembles the ammunition it simulates in appearance, feel and weight so as to give a realistic simulation experience. In addition, simulants in accordance with the invention are configured such that separation of the components are avoided.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
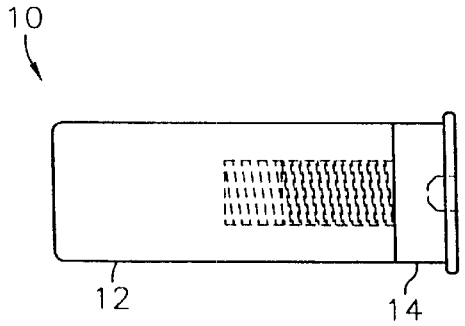
FIG. 1 is an elevational side view of a shotgun shell simulant in accordance with a preferred embodiment of the invention.

With initial reference to FIG. 1, there is shown a shotgun shell simulant 10 having a case or hull portion 12 and a base portion 14. The simulant 10 has an appearance, feel and weight which provides realistic simulation of a live or loaded shotgun shell. Advantageously, the hull portion 12 is fixedly secured to the base portion 14 in a manner that avoids accidental separation of the hull portion 12 from the base portion 14.

Avoidance of accidental separation is desirable to render the shell simulant 10 suitable for training purposes with a variety of shotguns including those having a pump action wherein shells are cycled from a magazine of a shotgun to a firing chamber and then ejected by operation of the pump action by a user. It would be undesirable for separation of the components to occur, i.e., separation of the hull and base portions, since one or both of the components could remain in the shotgun and render it unusable or unsafe for subsequent use with live ammunition.

Figure 2:
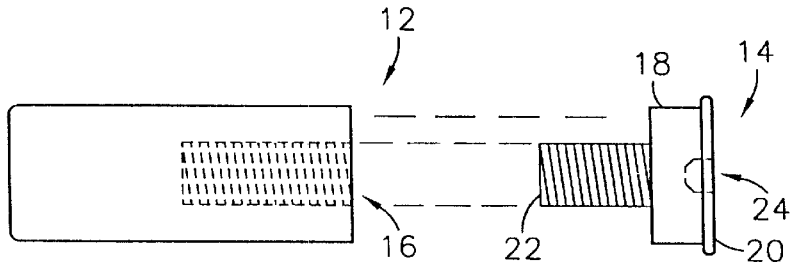
FIG. 2 is an exploded side view of the shotgun shell simulant of FIG. 1.
Figure 3:
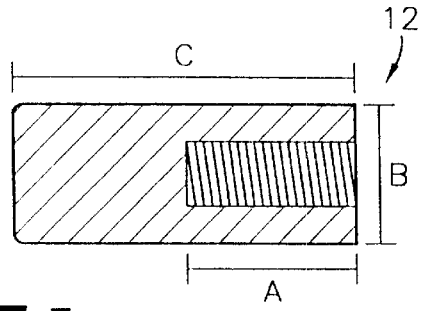
FIG. 3 is a cross-sectional view of a hull portion of the shell simulant of FIG. 1.
Figure 4:
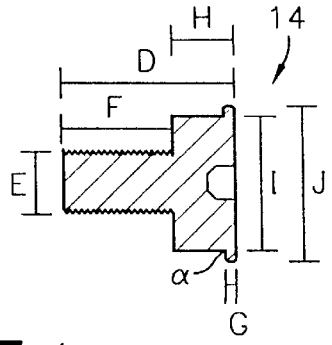
FIG. 4 is a cross-sectional view of a base portion of the shell simulant of FIG. 1.

Turning to FIGS. 2, 3 and 4, the hull portion 12 is preferably of solid, one-piece construction, preferably made of a plastic or polymeric material, most preferably nylon, using known molding techniques. The hull portion 12 is substantially cylindrical in shape to correspond in size and shape to the hull portion 12 of a shotgun shell. The hull portion 12 includes a threaded, preferably blind bore 16 co-axial to the center line of the hull portion and open at one end of the hull portion 12 for receiving a corresponding portion of the base 14. The bore 16 may be provided, as by drilling and threading.

The base portion 14 is preferably of solid, one-piece construction, preferably made of a metallic material, most preferably brass, using known milling or turning techniques. The base portion 14 includes a head 18 which is substantially cylindrical in shape and includes a circumferential rim 20 to simulate the appearance and external structure of the base portion of a shotgun shell. The base portion 14 includes a stud 22 extending co-axial to the center line of the base portion and threaded so as to be threadably receivable within the blind bore 16 of the hull portion 12.

A bore 24 is also preferably centrally provided on the head 18 opposite the stud 22 as clearance for a firing pin of a shotgun so that the shotgun may be dry fired when the simulated shell 10 is positioned within a firing chamber of the shotgun. Additionally, a resilient energy absorbing material, such as foam or a spring, may be placed within the bore 24 for dry firing purposes for avoiding damage to the firing pin of the shotgun.

For the purpose of an example, the hull 12 is preferably dimensioned as set forth in Table 1 below to simulate the hull of a 12 gauge shotgun shell. It will be appreciated that the hull 12 may be provided in various dimensions to enable its use with various other gauges such as 16 gauge, 20 gauge, 28 gauge and 410 bore shotguns.

TABLE 1

| Dimension | Inches |
|---|---|
| A | 1.0 length, 0.3125 inch diameter and threaded (3/8–16 thread) |
| B | 0.78 |
| C | 1.95 |

Likewise, the base 14 is preferably dimensioned as set forth in Table 2 below to simulate the base or brass portion of a 12 gauge shotgun shell.

TABLE 2

| Dimension | Inches |
|---|---|
| D | 0.975 |
| E | 0.375 |
| F | 0.650 (3/8-16 thread) |
| α | 95° |
| G | 0.050 |
| H | 0.325 |
| I | 0.800 |
| J | 0.881 |

The hull portion 12 as configured above preferably has a weight of from about 13 grams to about 19 grams and the base portion 14 as configured above preferably has a weight of from about 32 grams to about 36 grams, such that the overall weight of the simulated shell is from about 47 grams to about 53 grams. It has been observed that this range substantially approximates the typical weight range of shotgun shells, whose weight generally varies from about 41 grams to about 67 grams, depending on the powder and shot charge and other characteristics of the shotgun shell.

Figure 5:
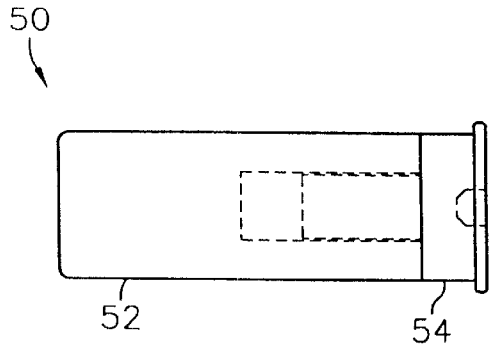
FIG. 5 is an elevational side view of a shotgun shell simulant in accordance with another embodiment of the invention.

With reference now to FIG. 5, there is shown an alternate embodiment of a shotgun shell simulant 50 having a hull portion 52 and a base portion 54. The simulant 50 also has an appearance, feel and weight which provides realistic simulation of a live shotgun shell. Advantageously, the hull portion 52 is fixedly secured to the base portion 54 in a manner that avoids accidental separation of the hull portion 52 from the base portion 54.

Figure 6:
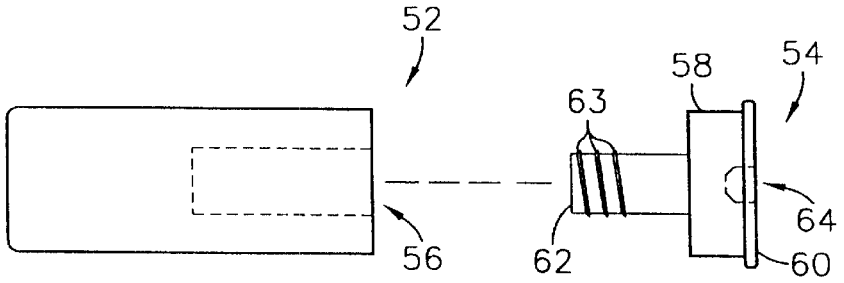
FIG. 6 is an exploded side view of the shotgun shell simulant of FIG. 5.
Figure 7:
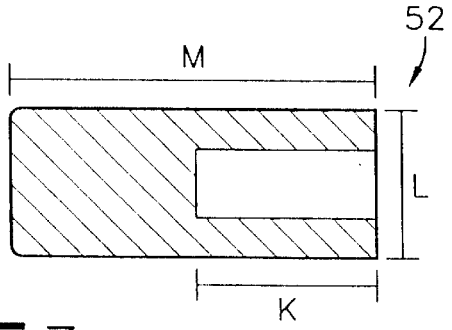
FIG. 7 is a cross-sectional view of a hull portion of the shell simulant of FIG. 5.
Figure 8:
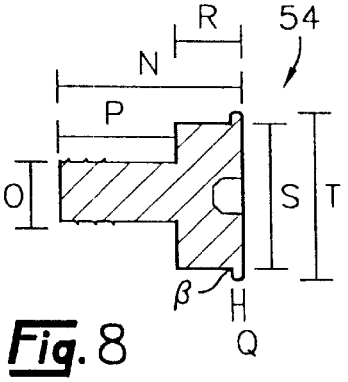
FIG. 8 is a cross-sectional view of a base portion of the shell simulant of FIG. 5.

Turning to FIGS. 6, 7 and 8, the hull portion 52 is preferably of solid, one-piece construction, preferably made of a plastic or polymeric material, most preferably nylon, using known molding techniques. The hull portion 52 is substantially cylindrical in shape to correspond in size and shape to the hull portion of a shotgun shell. The hull portion 52 includes a blind bore 56 co-axial to the center line of the hull portion and open at one end of the hull portion 52 for receiving a corresponding portion of the base 54. The bore 56 may be provided, as by drilling, and is preferably of smooth bore.

The base portion 54 is preferably of solid, one-piece construction, preferably made of a metallic material, most preferably brass, using known turning or milling techniques. The base portion 54 includes a head 58 which is substantially cylindrical in shape and includes a circumferential rim 60 to simulate the appearance of the base portion of a shotgun shell. The base portion 54 includes a stud 62 extending co-axial to the center line of the base portion and configured so as to be receivable within the blind bore 56 of the hull portion 52. In this regard, the stud 62 preferably includes a plurality of projections or protrusions such as annular rings, serrations or angled barbs 63 for frictionally and mechanically engaging the sidewalls of the bore 56 of the hull portion 52 to retain the stud 62 within the bore 56. The shell simulant 50 may be readily assembled by press-fitting the stud 62 into the bore 56, the barbs 63 being of sufficient dimension to provide a fit sufficient to maintain the assembly of the shell 50 during use of the shell as a training device with shotguns.

A blind bore 64 is also preferably centrally provided on the head 58 opposite the stud 62 as clearance for a firing pin of a shotgun so that the shotgun may be dry fired when the simulated shell 50 is positioned within the firing chamber of the shotgun.

Figure 14:
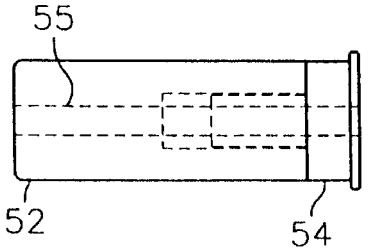
FIG. 14 is a side view of an alternative embodiment of the shell of FIG. 5 which enables a primer to be used in combination with the simulant.

The bore 64 (and blind 24) is preferably blind. However, it will be understood that the bore 64 may be made contiguous through the stud 62 and communicate with the bore 56, which may be extended to communicate with the other end of the hull portion. This would provide a continuous open bore 55 such that a live primer could be seated in the bore 64 (or bore 24) and fired to simulate firing of the shotgun. See, FIG. 14.

For the purpose of an example, the hull 52 is preferably dimensioned as set forth in Table 3 below to simulate the hull of a 12 gauge shotgun shell. It will be appreciated that the hull 52 may be provided in various dimensions to enable its use with various other gauges such as 16 gauge, 20 gauge and 410 bore shotguns.

TABLE 3

| Dimension | Inches |
|---|---|
| K | 1.0 length, 0.3125 inch diameter |
| L | 0.78 |
| M | 1.95 |

Likewise, the base 54 is preferably dimensioned as set forth in Table 4 below to simulate the base or brass portion of a 12 gauge shotgun shell.

TABLE 4

| Dimension | Inches |
|---|---|
| N | 0.975 |
| O | 0.375 |
| P | 0.650 |

TABLE 4-continued

| Dimension | Inches |
|---|---|
| β | 95° |
| Q | 0.050 |
| R | 0.325 |
| S | 0.800 |
| T | 0.881 |

The shell 50 (and the components thereof) has a weight which substantially corresponds to that of the shell 10 (and components thereof) as previously described.

Figure 9:
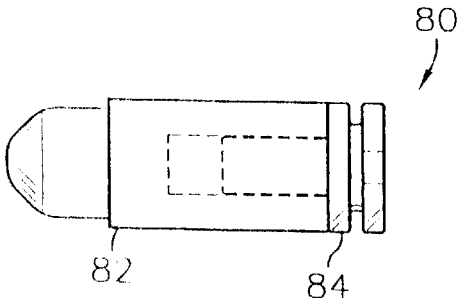
FIG. 9 is an elevational side view of a centerfire ammunition simulant in accordance with another embodiment of the invention.

With reference now to FIG. 9, there is shown an alternate embodiment of an ammunition simulant 80 having a casing/bullet portion 82 and a base portion 84. The simulant 80 also has an appearance, feel and weight which provides realistic simulation of live centerfire ammunition. Advantageously, the casing/bullet portion 82 is fixedly secured to the base portion 84 in a manner that avoids accidental separation of the casing/bullet portion 82 from the base portion 84.

Figure 10:
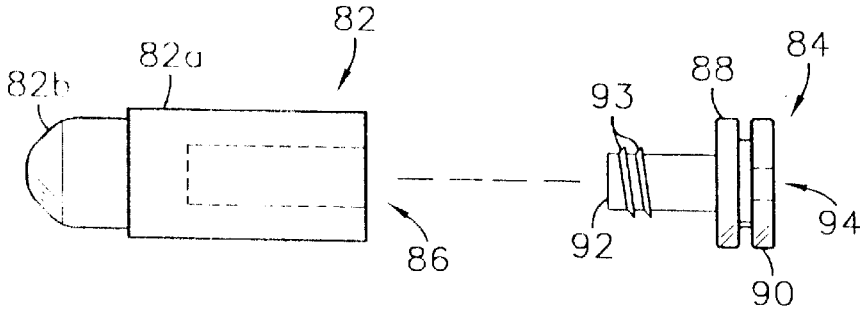
FIG. 10 is an exploded side view of the simulant of FIG. 9.
Figure 11:
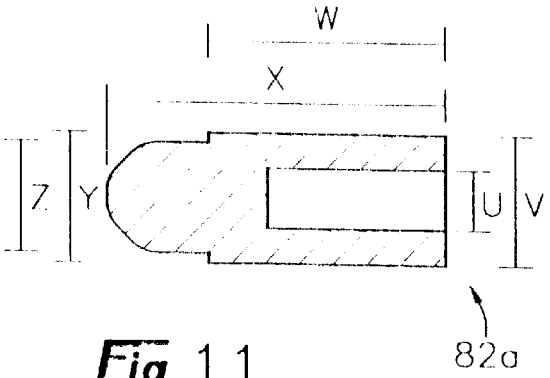
FIG. 11 is a cross-sectional view of a casing/bullet portion of the shell simulant of FIG. 9.
Figure 12:
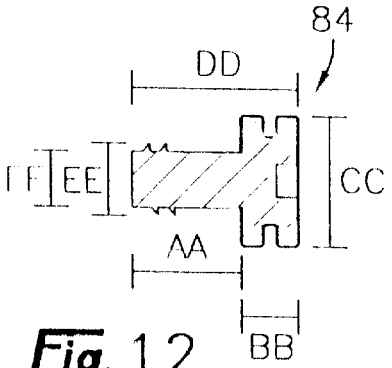
FIG. 12 is a cross-sectional view of a base portion of the shell simulant of FIG. 9.

Turning to FIGS. 10, 11 and 12, the casing/bullet portion 82 is preferably of solid, one-piece construction, preferably made of a plastic or polymeric material, most preferably nylon, using known molding techniques. The casing/bullet portion 82 has a substantially cylindrical casing portion 82*a*, the exterior of which corresponds in size and shape to the exterior of the casing portion of a conventional centerfire ammunition round and a bullet portion 82*b* which corresponds in size and shape to the exposed portion of a bullet as seated in a conventional centerfire round. The casing/bullet portion 82 includes a preferably blind bore 86 co-axial to the center line of the casing/bullet portion and open at one end of the casing/bullet portion 82 for receiving a corresponding portion of the base 84. The bore 86 may be provided, as by drilling, and is preferably of smooth bore.

Figure 13:
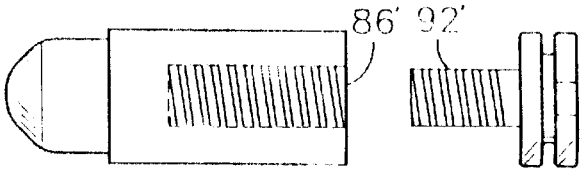
FIG. 13 is an exploded side view of another embodiment of a centerfire ammunition simulant.

The base portion 84 is preferably solid, one-piece construction, preferably made of a metallic material, most preferably brass, using known milling and turning techniques. The base portion 84 includes a head 88 having a circumferential groove/rim 90 to simulate the appearance of the base portion of centerfire ammunition. The base portion 84 includes a stud 92 extending co-axial to the center line of the base portion and configured so as to be receivable within the bore 86 of the casing/bullet portion 82. In this regard, the stud 92 preferably includes a plurality of protrusions such as annular rings or angled barbs 93 for frictionally and mechanically engaging the sidewalls of the bore 86 of the casing/bullet portion 82 to retain the stud 92 within the bore 86. The shell simulant 80 may be readily assembled by press-fitting the stud 92 within the bore 86 to provide a fit sufficient to maintain the assembly of the shell 80 during use of the shell as a training device with centerfire firearms. Alternatively, as shown in FIG. 13, the simulant 80 may include a stud 92' which is threaded and a bore 86' having receiving threads in the manner previously described in connection with the simulant 10.

A blind bore 94 is also preferably centrally provided on the head 88 opposite the stud 92 as clearance for a firing pin of a centerfire pistol or rifle so that the pistol or rifle may be dry fired when the simulated shell 80 is positioned within the firing chamber of the firearm. The bore 94 may also be made contiguous with the bore 86 to provide a continuous bore for enabling use of a primer.

For the purpose of an example, the casing/bullet 82 is preferably dimensioned as set forth in Table 5 below to simulate the casing/bullet of a 9 mm Luger centerfire pistol round. It will be appreciated that the casing/bullet 82 may be provided in various dimensions to enable its use with various other centerfire pistol and rifle calibers, e.g., 45 cal., 30-06 Springfield and the like.

TABLE 5

| Dimension | Inches |
|---|---|
| U | 0.5 - depth, .221 - diameter |
| V | 0.387 |
| W | 0.545 |
| X | 0.800 |
| Y | 0.335 |
| Z | 0.325 |

Likewise, the base 84 is preferably dimensioned as set forth in Table 6 below to simulate the base of a 9 mm centerfire pistol round.

TABLE 6

| Dimension | Inches |
|---|---|
| AA | 0.370 |
| BB | 0.160 |
| CC | 0.387 |
| DD | 0.530 |
| EE | 0.224 |
| FF | 0.187 |

The casing/bullet portion 82 as configured above preferably has a weight of from about 0.03 oz. to about 0.07 oz. and the base portion 84 as configured above preferably has a weight of from about 0.015 oz. to about 0.025 oz., such that the overall weight of the simulated shell is from about 0.02 oz. to about 0.03 oz. It has been observed that this range substantially approximates the typical weight of 9 mm centerfire pistol rounds, which generally weigh from about 0.03 oz. to about 0.04 oz., depending on the bullet weight.

Figure 15:
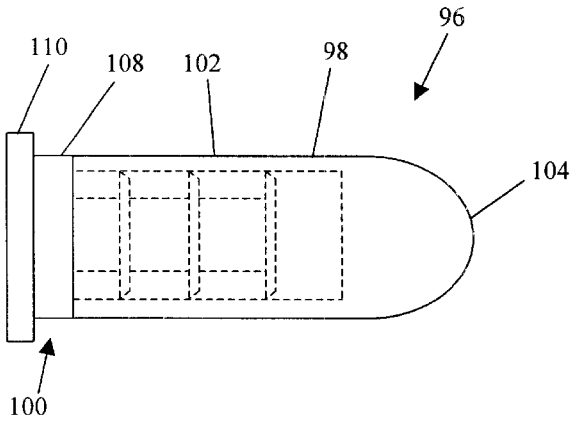
FIG. 15 is a side view of a rimfire ammunition simulant in accordance with yet another embodiment of the invention.

With reference now to FIG. 15, there is shown yet an alternate embodiment of an ammunition simulant 96 having a casing/bullet portion 98 and a base portion 100 The simulant 96 also has an appearance, feel and weight which provides realistic simulation of live rimfire ammunition, e.g. 22 long rifle ammunition. Advantageously, the casing/bullet portion 98 is fixedly secured to the base portion 100 in a manner that avoids accidental separation of the casing/bullet portion 98 from the base portion 100.

Figure 16:
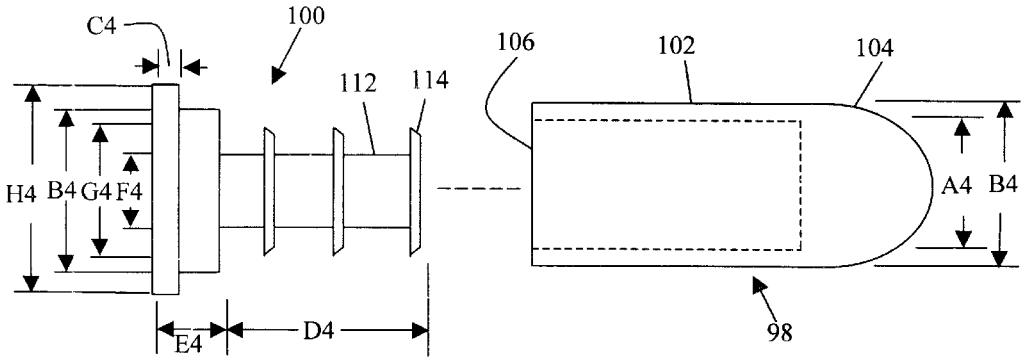
FIG. 16 is an exploded side view of the rimfire ammunition simulant of FIG. 15.

With additional reference to FIG. 16, the casing/bullet portion 98 is preferably of solid, one-piece construction, preferably made of a plastic or polymeric material, most preferably nylon as by injection molding. The casing/bullet portion 98 has a substantially cylindrical casing portion 102 and a bullet portion 104. The casing/bullet portion 98 is attached to the base portion 100 to yield the simulant 96, having a size and shape corresponding to the size and shape of a conventional rimfire round. The casing/bullet portion 98 includes a preferably blind bore 106 co-axial to the center line of the casing/bullet portion and open at one end of the casing/bullet portion 98 for receiving a corresponding portion of the base 100 The bore 106 may be provided, as by drilling, and is preferably of smooth bore.

The base portion 100 is preferably solid, one-piece construction, preferably made of a metallic material, most preferably brass, as by milling. The base portion 100 includes a head 108 having a circumferential rim 110 to simulate the appearance of the base portion of rimfire ammunition. The base portion 100 includes a stud 112 extending co-axial to the center line of the base portion 100 and configured so as to be receivable within the bore 106 of the casing/bullet portion 98. In this regard, the stud 112 preferably includes a plurality of protrusions such as annular rings or angled barbs 114 for frictionally and mechanically engaging the sidewalls of the bore 106 of the casing/bullet portion 98 to retain the stud 112 within the bore 106. The shell simulant 96 may be readily assembled by press-fitting the stud 112 within the bore 106 to provide a fit sufficient to maintain the assembly of the shell 96 during use of the shell as a training device with rimfire firearms.

Figure 17:
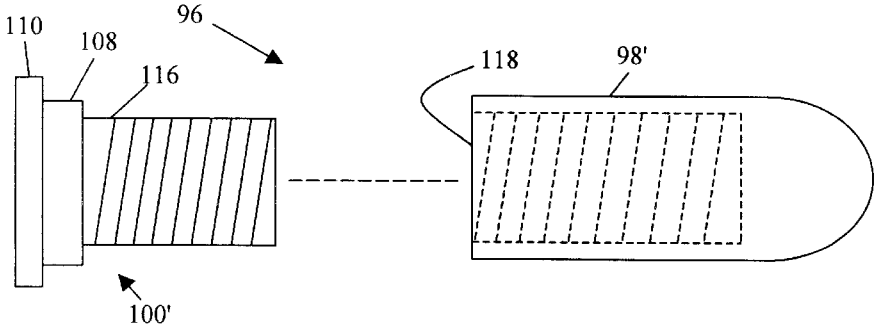
FIG. 17 is an exploded side view of another embodiment of a rimfire ammunition simulant in accordance with the invention.

Alternatively, as shown in FIG. 17, base portion 100' may include a threaded stud 116 and casing/bullet portion 98' include a corresponding threaded bore 118 for receiving the stud 116.

For the purpose of an example, the casing/bullets 98 and 98' and base portions 100 and 100' are preferably dimensioned as set forth in Table 7 below and FIG. 16, so that when assembled they simulate a 0.22 long rifle rimfire round. It will be appreciated that the casing/bullets 98 and 98' and base portions 100 and 100' may be provided in various dimensions to enable its use with various other rimfire pistol and rifle calibers, e.g., 0.22 short, long, 22 WMR and the like.

TABLE 7

| Dimension | Inches |
|---|---|
| A4 | .375 depth, .110 - diameter |
| B4 | .221 |
| C4 | .035 |
| D4 | .325 |
| E4 | .175 |
| F4 | .095 |
| G4 | .120 |
| H4 | .270 |

The casing/bullet portion 98 as configured above preferably has a weight of from about ⅛ oz. to about ¼ oz. and the base portion 100 as configured above preferably has a weight of from about ¼ oz. to about ½ oz., such that the overall weight of the simulated shell is from about ⅜ oz. to about ¾ oz. It has been observed that this range substantially approximates the typical weight of 0.22 long rifle rimfire rounds, which generally weigh from about ½ oz. to about ¾ oz., depending on the bullet weight.

Figure 18:
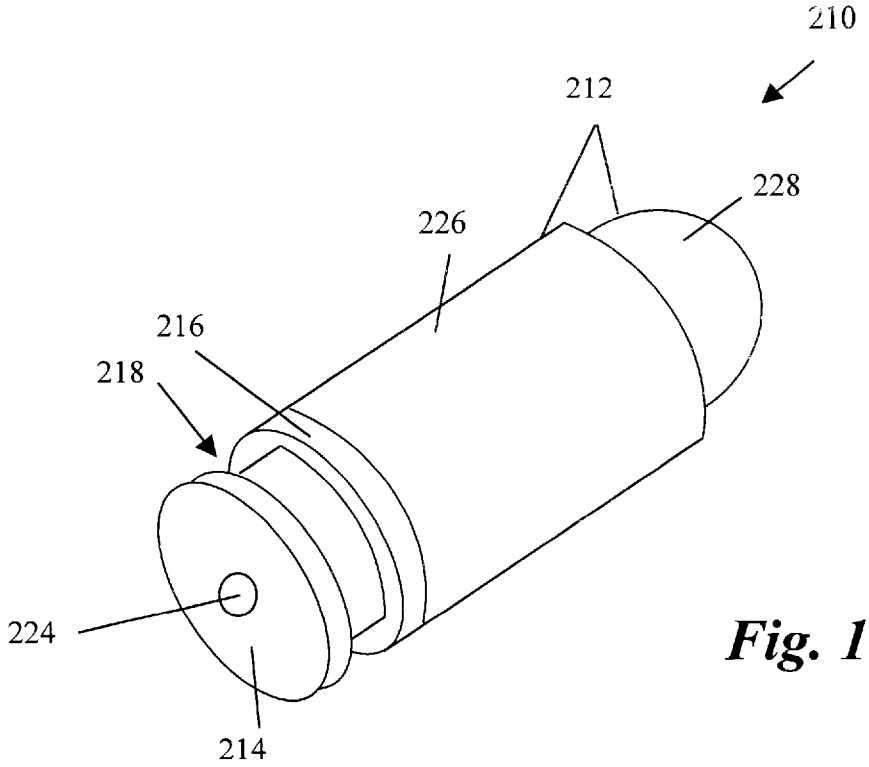
FIG. 18 is an isometric view of a centerfire ammunition simulant in accordance with yet another embodiment of the invention.

Referring now to FIG. 18, there is shown an injection molded centerfire ammunition simulant 210 in accordance with still another embodiment of the invention. The simulant 210 includes a casing/bullet portion 212 and a base portion 214. The injection molding process is suitable for providing a variety of simulants, including but not limited to centerfire and rimfire ammunition, and shotgun shell simulants. The simulants in accordance with the invention have an appearance, feel and weight which provides realistic simulation of live ammunition. Simulants 210 manufactured in accordance with the invention advantageously have the casing/bullet portion 212 fixedly secured to the base portion 214 in a manner that helps to avoid accidental separation of the casing/bullet portion 212 from the base portion 214 together with a permanent in-situ portion for dissipating shock on a firing pin for dry-firing purposes.

Preferably, the base portion 214 of the centerfire simulant 210 is of a solid, one-piece construction, preferably made of a metallic material, most preferably brass, using known milling or turning techniques. As described further below, an injection molding process is used to fixedly secure the casing/bullet portion 212 to the base portion 214 in a manner that helps to avoid accidental separation of the casing/bullet portion 212 from the base portion 214.

Figure 19:
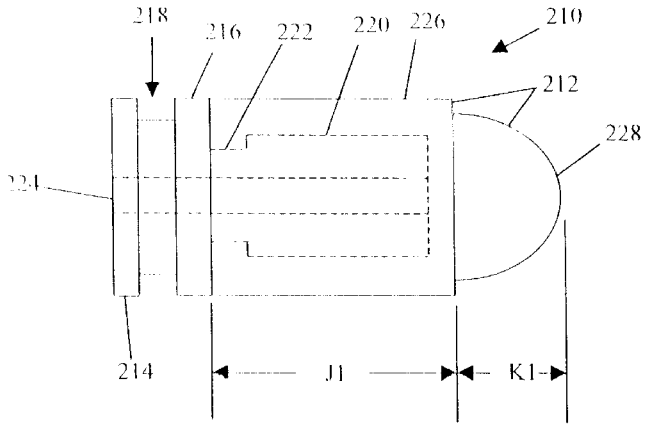
FIG. 19 is a side view of the centerfire ammunition simulant of FIG. 18.

With additional reference to FIG. 19, the base portion 214 includes a head 216 having a circumferential groove/rim 218 to simulate the appearance of the base portion of centerfire ammunition. The groove/rim 218 enables the extractor mechanism of the centerfire weapon to engage the simulant 210 when the simulant 210 is loaded from an ammunition cartridge into the firing chamber of the weapon. The base portion 214 includes a stud 220 that preferably extends co-axially to the center line of the base portion 214. The stud 220 preferably has a diameter which is less than the diameter of the base portion 214, and as described further below, the injection molded casing/bullet portion 212 encompasses the difference once the molded casing/bullet portion is injection molded to the stud 220.

The stud 220 includes a circumferential recess 222 having a width and a depth, which is preferably proximately located with respect to the head 216. However, the circumferential recess 222 can be located at various locations along the length of the stud 220. Moreover, more than one circumferential recess 222 can be located along the length of the stud 220, wherein the width of each circumferential recess 222 preferably decreases as the number of circumferential recesses increases along the length of the stud 220. As described further below, as the length of the stud 220 increases, it is preferred that more than one circumferential recess 222 be located along the length of the stud 220.

Figure 20:
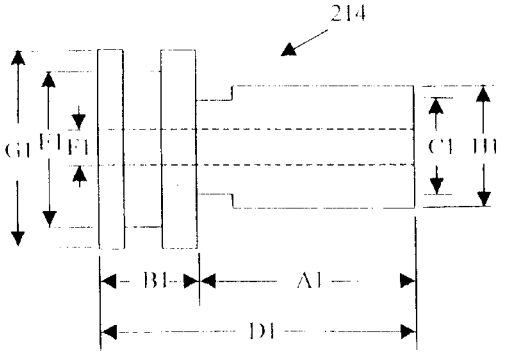
FIG. 20 is a side view of a portion of the centerfire ammunition simulant of FIGS. 19 and 20.
Figure 20A:
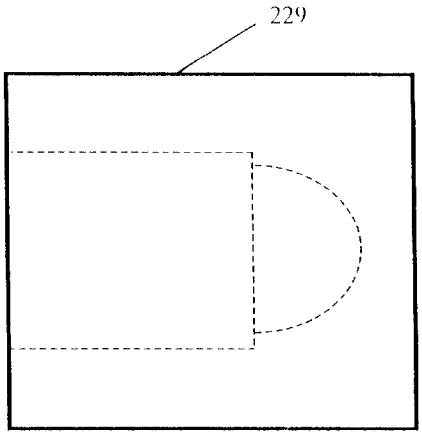
FIG. 20*a* is a representative view of a mold for use in making the simulant.
Figure 20B:
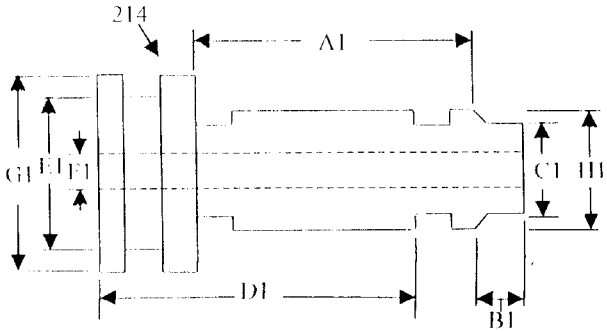
FIG. 20*b* is a side view of a portion of a centerfire ammunition simulant in accordance with another embodiment of the invention.

The base portion 214 also preferably includes a coaxial bore 224 having a diameter, extending therethrough. The centerfire base portion 214 is dimensioned according to the desired ammunition simulant 210. With additional reference to FIGS. 20 and 20*b*, Table 8 lists examples of dimensions (in inches) for the base portion 214 and the casing/bullet portion 212 according to various centerfire ammunition types.

TABLE 8

| Dimension (millimeters) | A1 | B1 | C1 | D1 | E1 | F1 | G1 | H1 | J1 | K1 |
|---|---|---|---|---|---|---|---|---|---|---|
| Simulant | | | | | | | | | | |
| 9 mm | .462 | .218 | .258 | .690 | .335 | .140 | .387 | .300 | .500 | .300 |
| .270 | 1.740 | .200 | .250 | 1.948 | .394 | .140 | .468 | .300 | 1.957 | 1.045 |
| .30–06 | 1.750 | .200 | .260 | 1.948 | .399 | .170 | .468 | .310 | 1.986 | 1.132 |
| .44 mag | 1.050 | .200 | .250 | 1.270 | .450 | .170 | .508 | .300 | 1.070 | .300 |

The base portion 214 and its constituent elements provide a structure for adhering molten plastic to the base portion 214, forming the casing/bullet 212, thereby operating to replicate various ammunition types according to the specific mold used for a desired centerfire simulant 210. The casing/bullet portion 212 has a substantially cylindrical casing portion 226, the exterior of which corresponds in size and shape to the exterior of the casing portion of a conventional centerfire ammunition round and a bullet portion 228 which corresponds substantially in size and shape to the exposed portion of a bullet as seated in a conventional centerfire round.

Once it is decided to which type or types of ammunition simulants are desired, in accordance with the invention a specific mold 229 (FIG. 20*a*) is provided for the casing/bullet portion 212 having dimensions which are substantially the same as the live ammunition to which the simulant 210 is modeled. Referring again to FIG. 19 and Table 8, various dimensions are shown for different casing/bullet types according to the centerfire ammunition simulant.

The injection molding process utilizes the mold to inject a mold material such as a plastic or polymeric material, such as nylon, for example. Once a particular mold is selected according to the desired ammunition type along with the corresponding base portion 214, the mold is placed about the base portion 214 so that the stud 220 is substantially completely encompassed by the mold abutting against the head 216. Once the mold is in place, the injection molding equipment is preferably operated to inject molten polymeric material into the mold through an orifice provided with the mold. The molten material flows through the orifice and into the mold encompassing the stud 220 and filling in the space defined by the differing stud and head diameters. The molten material also flows into and throughout the coaxial bore 224 and circumferential recess 222.

After a predetermined amount of time, the mold material hardens and the mold is removed. Any excess mold material may be removed by grinding or cutting, leaving a simulant, such as the centerfire ammunition simulant 210 of FIG. 18. Preferably, the machining of the base portion 214 and the injection molding process is automated so that all that is required is for a user to input a desired ammunition simulant type, for example through a peripheral device, such as a handheld computer, and one or more ammunition simulants are produced according to the input. Preferably, the peripheral device includes the various dimensional characteristics of each simulant type in memory or can be input by the user.

Once the mold sets, the casing/bullet portion 212 is frictionally and mechanically engaged to the base portion 214. More specifically, a "lock" is formed between the set mold and the circumferential recess 222, so that the casing/bullet portion 212 is substantially permanently attached to the base portion 214, providing a fit sufficient to maintain the assembly of the casing/bullet portion 212 during use of the simulant 210 as a training device with centerfire firearms. Furthermore, a dampening mechanism is provided by the mold material encompassing the bore 224 of the base portion. More specifically, when the simulant 210 is chambered in a weapon and "dry fired", the material in the bore 224 acts to dissipate the shock conveyed by the firing pin of the weapon, thereby substantially reducing the damage to the firing pin of the weapon.

As an example, the casing/bullet portion 212 for a 9 mm simulant 210 as configured above preferably has a weight of from about 0.03 oz. to about 0.07 oz. and the base portion 214 for a 9 mm simulant 210 as configured above preferably has a weight of from about 0.015 oz. to about 0.025 oz., such that the overall weight of the simulated centerfire ammunition is from about 0.02 oz. to about 0.03 oz. It has been observed that this range substantially approximates the typical weight of 9 mm centerfire pistol rounds, which generally weigh from about 0.03 oz. to about 0.04 oz., depending on the bullet weight.

Figure 21:
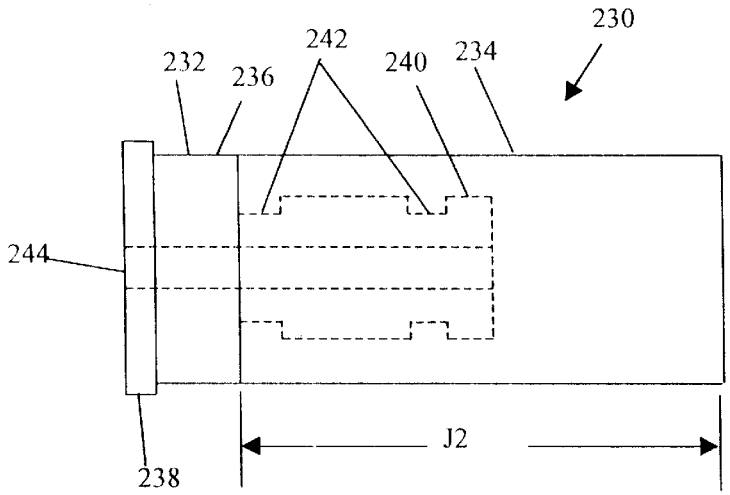
FIG. 21 is a side view of a shotgun shell simulant in accordance with yet another embodiment of the invention.
Figure 22:
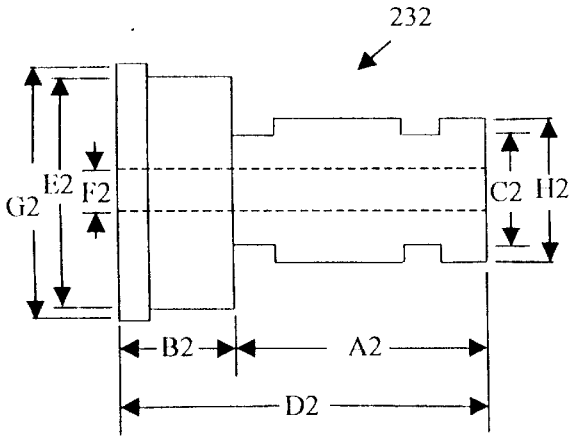
FIG. 22 is a side view of a portion of the shotgun shell simulant of FIG. 21.

Referring now to FIGS. 21 and 22, and with additional reference to Table 9, a description of an injected molded shotgun shell simulant 230 follows. The shotgun shell simulant 230 includes a base portion 232 and a hull portion 234. The base portion 234 includes a head 236 which is substantially cylindrical in shape and includes a circumferential rim 238 to simulate the appearance and external structure of the base portion of a shotgun shell. The base portion 232 includes a stud 240 extending co-axial to the center line of the base portion 232 and includes one or more, most preferably two circumferential recesses 242. The base portion 232 also preferably includes a bore 244 coaxially located therethrough.

TABLE 9

| Dimension (inches) | A2 | B2 | C2 | D2 | E2 | F2 | G2 | H2 | J2 |
|---|---|---|---|---|---|---|---|---|---|
| Simulant | | | | | | | | | |
| 12 gauge | 1.0 | .450 | .540 | 1.450 | .795 | .175 | .880 | .600 | 1.825 |
| 16 gauge | 1.0 | .450 | .500 | 1.450 | .730 | .175 | .809 | .550 | 1.850 |
| 20 gauge | 1.0 | .450 | .320 | 1.450 | .690 | .175 | .756 | .380 | 1.850 |
| 28 gauge | 1.0 | .380 | .260 | 1.450 | .615 | .175 | .681 | .440 | 1.850 |
| .410 bore | 1.0 | .450 | .260 | 1.450 | .472 | .150 | .528 | .300 | 1.790 |

The injection molding process is substantially the same for a shotgun shell simulant 230 as for the centerfire simulant 210 described above. The base portion 232 and its constituent elements provide a structure for adhering molten plastic to the base portion 232, forming the hull 234, thereby operating to replicate various shell types according to the specific mold used for a desired shotgun shell simulant 230. The hull 234 is substantially cylindrical, the exterior of which corresponds in size and shape to the exterior of the hull portion of a conventional shotgun shell.

Figure 22A:
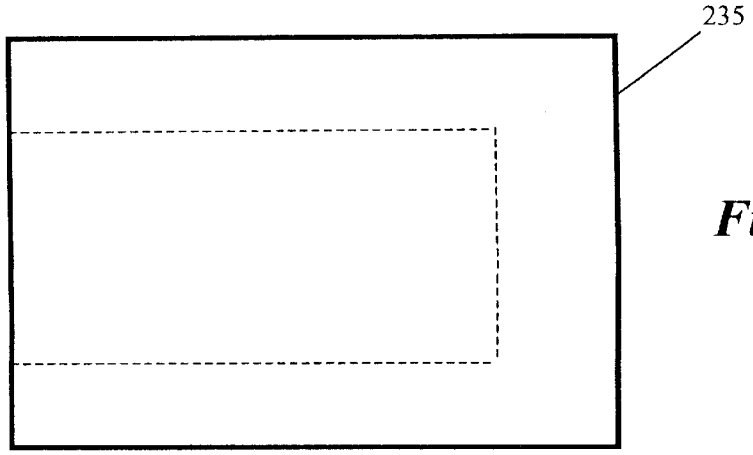
FIG. 22*a* is a representative view of a mold for use in making the simulant.

Once it is decided to which type or types of shotgun shell simulants 230 are desired, according to the invention, a specific mold 235 (FIG. 22*a*) is provided for the hull 234 having dimensions which are substantially the same as the shotgun shell hull to which the simulant 230 is modeled. Referring again to FIG. 21 and Table 9, various dimensions are shown for different hull types according to the shotgun shell simulant 230.

As described above, the injection molding process utilizes the mold to inject a mold material such as nylon. Once a particular mold is selected according to the desired shell type along with the corresponding base portion 232, the mold is placed about the base portion 232 so that the stud 240 is completely encompassed by the mold abutting against the head 236. Once the mold is in place, the injection molding equipment injects molten mold material into the mold through an orifice provided with the mold. The molten material flows through the orifice and into the mold encompassing the stud 240 and filling in the space defined by the differing stud and head diameters. The molten material also flows into and throughout the coaxial bore 244 and the circumferential recesses 242.

After a predetermined amount of time, the mold material hardens and the mold is removed. Any excess mold material may be removed by grinding or cutting, leaving a simulant, such as the shotgun shell simulant of FIG. 21. Preferably, the machining of the base portion 232 and the injection molding process is automated so that all that is required is for a user to input a desired shell simulant type, for example through a peripheral device, such as a handheld computer, and one or more shell simulants are produced according to the input. Preferably, the peripheral device includes the various dimensional characteristics of each simulant type in memory or can be input by the user.

According to the invention, once the mold sets, the hull 234 is frictionally and mechanically engaged to the base portion 232. More specifically, a "lock" is formed between the set mold and the circumferential recesses 242, so that the hull 234 is substantially permanently attached to the base portion 232, providing a fit sufficient to maintain the assembly of the hull 234 during use of the shotgun shell simulant 230 as a training device with shotguns. Furthermore, a dampening mechanism is provided by the mold material encompassing the bore 244 of the base portion 232. More specifically, when the shell simulant 230 is chambered in a shotgun and "dry fired", the material in the bore 244 acts to dissipate the shock conveyed by the firing pin of the shotgun, thereby substantially reducing the damage to the firing pin.

The hull 234 configured above preferably has a weight of from about 13 grams to about 19 grams and the base portion 232 as configured above preferably has a weight of from about 32 grams to about 36 grams, such that the overall weight of the shotgun shell simulant 230 is from about 47 grams to about 53 grams. It has been observed that this range substantially approximates the typical weight range of live shotgun shells, whose weight generally varies from about 41 grams to about 67 grams, depending on the powder and shot charge and other characteristics of the shotgun shell.

Figure 23:
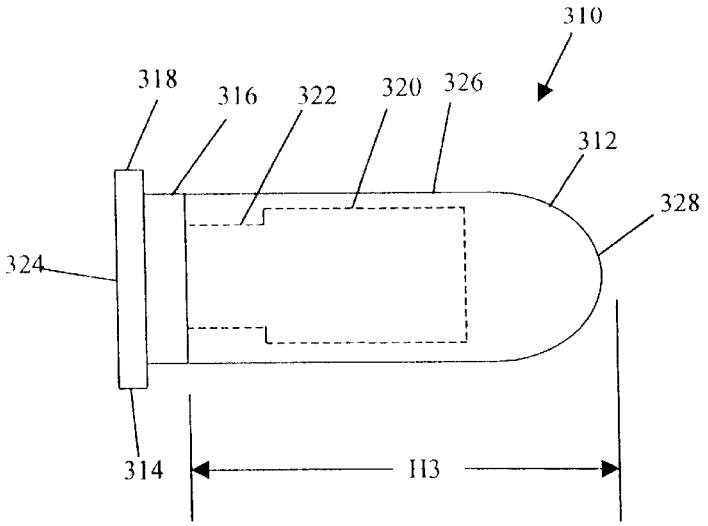
FIG. 23 is a side view of a rimfire ammunition simulant in accordance with yet another embodiment of the invention.

Referring now to FIG. 23, there is shown a side view of an injection molded rimfire ammunition simulant 310 in accordance with yet another embodiment of the invention. The simulant 310 includes a casing/bullet portion 312 and a base portion 314 formed according to an injection molding process as described in greater detail below. As described above with respect to centerfire and shotgun simulants, the injection molding process is further operable to provide rimfire ammunition simulants. The rimfire simulant 310 has an appearance, feel and weight which provides realistic simulation of live rimfire ammunition. Simulants 310 manufactured in accordance with the invention advantageously have the casing/bullet portion 312 fixedly secured to the base portion 314 in a manner that helps to avoid accidental separation of the casing/bullet portion 312 from the base portion 314.

Preferably, the base portion 314 of the rimfire simulant 310 is of a solid, one-piece construction, preferably made of a metallic material, most preferably brass, using known milling or turning techniques. As described further below, an injection molding process is used to fixedly secure the casing/bullet portion 312 to the base portion 314 in a manner that helps to avoid accidental separation of the casing/bullet portion 312 from the base portion 314.

Figure 24:
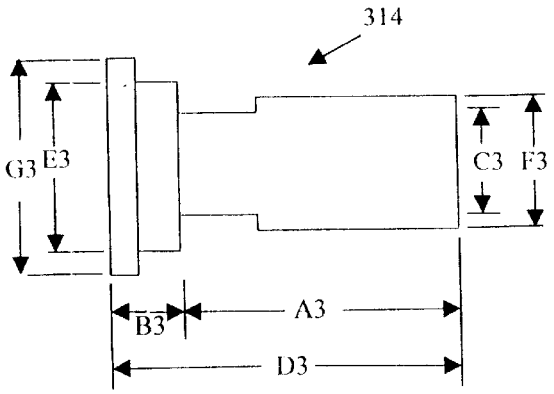
FIG. 24 is a side view of a portion of the rimfire ammunition simulant of FIG. 23.

With additional reference to FIG. 24, the base portion 314 includes a head 316 having a circumferential rim 318 to simulate the appearance of the base portion of rimfire ammunition. The rim 318 enables the extractor mechanism of the rimfire weapon to engage the simulant 310 when the simulant 310 is loaded from an ammunition cartridge into the firing chamber of the weapon. The rim 318 further provides the necessary structure for the firing mechanism of a rimfire weapon to strike the rim when 'fired'. The base portion 314 includes a stud 320 that preferably extends co-axially to the center line of the base portion 314. The stud 320 preferably has a diameter which is less than the diameter of the base portion 314, and as described further below, the injection molded casing/bullet portion 312 encompasses the difference once the molded casing/bullet portion is injection molded to the stud 320.

The stud 320 includes a circumferential recess 322 having a width and a depth, which is preferably proximately located with respect to the head 316. However, the circumferential recess 322 can be located at various locations along the length of the stud 320. Moreover, more than one circumferential recess 322 can be located along the length of the stud 320, wherein the width of each circumferential recess 322 preferably decreases as the number of circumferential recesses increases along the length of the stud 320. As the length of the stud 320 increases, it is preferred that more than one circumferential recess 322 be located along the length of the stud 320.

The rimfire base portion 314 is dimensioned according to the desired ammunition simulant 310. Table 10 lists examples of dimensions (in inches) for the base portion 314 and the casing/bullet portion 312 according to various rimfire ammunition types.

TABLE 10

| Dimension (millimeters) | A3 | B3 | C3 | D3 | E3 | F3 | G3 | H3 |
|---|---|---|---|---|---|---|---|---|
| Simulant | | | | | | | | |
| .22 short | .300 | .150 | .119 | .450 | .223 | .149 | .270 | .532 |
| .22 long | .400 | .150 | .119 | .550 | .223 | .149 | .270 | .720 |
| .22 long rifle | .400 | .150 | .119 | .550 | .223 | .149 | .270 | .825 |
| .22 Mag. | .850 | .150 | .139 | 1.0 | .237 | .159 | .288 | 1.180 |

The base portion 314 and its constituent elements provide a structure for adhering molten plastic to the base portion 314, forming the casing/bullet 312, thereby operating to replicate various ammunition types according to the specific mold used for a desired rimfire simulant 310. The casing/bullet portion 312 has a substantially cylindrical casing portion 326, the exterior of which corresponds in size and shape to the exterior of the casing portion of a conventional rimfire ammunition round and a bullet portion 328 which corresponds substantially in size and shape to the exposed portion of a bullet as seated in a conventional rimfire round.

Figure 24A:
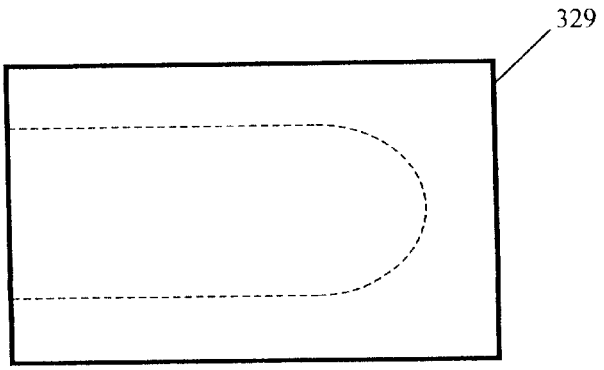
FIG. 24*a* is a representative view of a mold for use in making the simulant.

Once it is decided to which type or types of rimfire ammunition simulants are desired, in accordance with the invention a specific mold 329 (FIG. 24*a*) is provided for the casing/bullet portion 312 having dimensions which are substantially the same as the live ammunition to which the simulant 310 is modeled. Referring again to FIG. 23 and Table 10, various dimensions are shown for different casing/bullet types according to the rimfire ammunition simulant.

The injection molding process utilizes the mold to inject a mold material such as a plastic or polymeric material, such as nylon, for example. Once a particular mold is selected according to the desired ammunition type along with the corresponding base portion 314, the mold is placed about the base portion 314 so that the stud 320 is substantially completely encompassed by the mold abutting against the head 316. Once the mold is in place, the injection molding equipment is preferably operated to inject molten polymeric material into the mold through an orifice provided with the mold. The molten material flows through the orifice and into the mold encompassing the stud 320 and filling in the space defined by the differing stud and head diameters. The molten material also flows into and throughout the circumferential recess 322.

After a predetermined amount of time, the mold material hardens and the mold is removed. Any excess mold material may be removed by grinding or cutting, leaving a simulant, such as the rimfire ammunition simulant 310 of FIG. 23. Preferably, the machining of the base portion 314 and the injection molding process is automated so that all that is required is for a user to input a desired ammunition simulant type, for example through a peripheral device, such as a handheld computer, and one or more ammunition simulants are produced according to the input. Preferably, the peripheral device includes the various dimensional characteristics of each simulant type in memory or can be input by the user.

According to the invention, once the mold sets, the casing/bullet portion 312 is frictionally and mechanically engaged to the base portion 314. More specifically, a "lock" is formed between the set mold and the circumferential recess 322, so that the casing/bullet portion 312 is substantially permanently attached to the base portion 314, providing a fit sufficient to maintain the assembly of the casing/bullet portion 312 during use of the simulant 310 as a training device with rimfire firearms.

As an example, the casing/bullet portion 314 for a .22 long rifle simulant 310 as configured above preferably has a weight of from about ⅛ oz. to about ¼ oz. and the base portion 314 for a 0.22 long rifle simulant 310 as configured above preferably has a weight of from about ¼ oz. to about ½ oz., such that the overall weight of the simulated rimfire ammunition is from about ⅜ oz. to about ¾ oz. It has been observed that this range substantially approximates the typical weight of 0.22 long rifle rimfire rounds, which generally weigh from about ½ oz. to about ¾ oz., depending on the bullet weight.

Ammunition simulants in accordance with the invention are suitable for use in conventional firearms for training purposes and are compatible with the mechanisms thereof. That is, the simulants are configured so that they mechanically cooperate with magazine, feed and ejection mechanisms of conventional firearms in the same manner as ammunition does. This enables the actions of the firearms, such as the pump or lever action of a firearm, to be operated to cycle the simulants through the firearm in the same manner as live ammunition for the purpose of training. It should be noted that the examples described herein are not intended to limit the invention in any way, and furthermore, the invention is operable to provide ammunition simulants for virtually any weapon type.

The foregoing description of certain embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A method for making an ammunition simulant comprising the steps of:

providing a first body portion having a stud portion and a head portion, wherein the stud portion is in substantial coaxial alignment with the head portion, the stud portion including at least one engagement member located along the stud portion, the engagement member extending generally towards or away from the stud portion so as to define a surface topography generally different from that of the stud portion, providing a mold having a desired configuration and positioning the mold to substantially surround the stud portion, forming a second body portion by injecting molten material into the mold to cause the molten material to flow about the first portion and the at least one engagement member of the stud portion, and setting the thus applied molten material to form a shotgun shell simulant having substantially the same size, weight and appearance of a live shotgun shell, the set mold material forming the second body portion coupled with the first body portion substantially preventing accidental separation of the first and second body portions.

2. A method for making an ammunition simulant comprising the steps of:

providing a first body portion having a stud portion and a head portion, wherein the stud portion is in substantial coaxial alignment with the head portion, the stud portion including at least one engagement member located along the stud portion, the engagement member extending generally towards or away from the stud portion so as to define a surface topography generally different from that of the stud portion, providing a mold having a desired configuration and positioning the mold to substantially surround the stud portion, forming a second body portion by injecting molten material into the mold to cause the molten material to flow about the first portion and the at least one engagement member of the stud portion, and setting the thus applied molten material to form a centerfire simulant having substantially the same size, weight and appearance of a live centerfire round, the set mold material forming the second body portion coupled with the first body portion substantially preventing accidental separation of the first and second body portions.

3. A method for making an ammunition simulant comprising the steps of:

providing a first body portion having a stud portion and a head portion, wherein the stud portion is in substantial coaxial alignment with the head portion, the stud portion including at least one engagement member located along the stud portion, the engagement member extending generally towards or away from the stud portion so as to define a surface topography generally different from that of the stud portion, providing a mold having a desired configuration and positioning the mold to substantially surround the stud portion, forming a second body portion by injecting molten material into the mold to cause the molten material to flow about the first portion and the at least one engagement member of the stud portion, and setting the thus applied molten material to form a rimfire simulant having substantially the same size, weight and appearance of a live rimfire round, the set mold material forming the second body portion coupled with the first body portion substantially preventing accidental separation of the first and second body portions.

4. A method for making an ammunition simulant comprising the steps of:

providing a first body portion having a stud portion and a head portion, wherein the stud portion is in substantial coaxial alignment with the head portion, the stud portion including at least one engagement member located along the stud portion, the engagement member extending generally towards or away from the stud portion so as to define a surface topography generally different from that of the stud portion, providing a mold having a desired configuration and positioning the mold to substantially surround the stud portion, forming a second body portion by injecting molten material into the mold to cause the molten material to flow about the first portion and the at least one engagement member of the stud portion, wherein molten material encompasses the coaxial bore forming a shock dissipater for dissipating shock to a firing pin of a weapon with which the simulant is used, and setting the thus applied molten material to form an ammunition simulant, the set mold material forming the second body portion coupled with the first body portion substantially preventing accidental separation of the first and second body portions.

5. A method for manufacturing an ammunition simulant, comprising the steps of:

providing a solid, one piece base portion having a longitudinal axis, a head which is substantially cylindrical in shape and includes a circumferential rim, a stud extending co-axial to the longitudinal axis of the base portion, at least one engagement member having a structure extending towards or away from the stud, providing a longitudinal bore through the base portion, providing an injection mold device including a mold and mold material, locating the mold proximate the base portion of ammunition simulant, injecting a predetermined amount of mold material into the mold to form a mold portion, thereby encompassing the stud and engagement member of the base portion and admitting molten material into the bore and upon hardening forming a shock dissipater for a firing pin of a weapon with which the simulant is used, whereupon hardening of the mold a union is formed between the base portion and mold portion substantially preventing accidental separation thereof, and removing the mold to provide the ammunition simulant.

6. A rimfire ammunition simulant, comprising:

a solid, one-piece, first portion having a substantially cylindrical section having a longitudinal axis and including a blind bore provided therein at a location co-axial with the longitudinal axis of the cylindrical section and opening to a first end thereof, and a rounded section corresponding substantially in shape to the shape of a rimfire projectile and extending in longitudinal alignment with the blind bore opposite the first end; and a solid, one piece base portion having a longitudinal axis, a head which is substantially cylindrical in shape and includes a circumferential rim, a stud which extends co-axial to the longitudinal axis of the base portion, the stud being received by the blind bore of the first portion, and means for maintaining the stud within the blind bore, wherein the simulant has an appearance, feel and weight which provides realistic simulation of live rimfire ammunition.

7. The simulant of claim 6, wherein the means for maintaining the stud within the blind bore comprises a threaded bore and matingly threaded stud.

8. The simulant of claim 6, wherein the means for maintaining the stud within the blind bore comprises one or more protrusions extending outwardly from the stud for engaging a sidewall of the blind bore.

* * * * *